United States Patent [19]

Conti

[11] 4,155,227

[45] May 22, 1979

[54] PLANT FOR LIQUID TREATING TUBULAR FABRICS IN GENERAL

[76] Inventor: Fulvio Conti, via Statuto, 84, Bergamo, Italy

[21] Appl. No.: 786,694

[22] Filed: Apr. 11, 1977

[30] Foreign Application Priority Data

Aug. 11, 1976 [IT] Italy ..... 26214 A/76

[51] Int. Cl.[2] ..... D06B 1/02; D06B 23/04; D06C 3/08

[52] U.S. Cl. ..... 68/13 R; 26/81; 26/83; 68/205 R

[58] Field of Search ..... 68/13 R, 28, 62, 205 R, 68/181 R, 184; 26/81, 83

[56] References Cited

U.S. PATENT DOCUMENTS

| | | | |
|---|---|---|---|
| 2,045,755 | 6/1936 | Cohn | 68/205 R X |
| 2,769,685 | 11/1956 | Cowles et al. | 68/13 R X |
| 3,126,606 | 3/1964 | Beard | 26/83 |
| 3,267,704 | 8/1966 | Muller | 68/181 R X |
| 3,279,225 | 10/1966 | Knudsen | 68/205 R X |
| 3,470,571 | 10/1969 | Hrboticky | 68/205 R X |

FOREIGN PATENT DOCUMENTS

| | | | |
|---|---|---|---|
| 1801563 | 5/1969 | Fed. Rep. of Germany | 26/83 |

*Primary Examiner*—Philip R. Coe
*Attorney, Agent, or Firm*—Guido Modiano; Albert Josif

[57] ABSTRACT

Mercerisation plant for tubular fabrics comprising a tank for impregnating a tubular fabric with caustic soda, a station for stretching the impregnated fabric and for washing and rinsing the impregnated stretched fabric. The fabric is stretched in a station comprising at least one support structure of tower shape, members for feeding the fabric through the tower structure, at least one pair of expanding vertical rod elements for the fabric arranged inside thereof and support members engaging the expanding rod elements and adapted to enable these elements to approach or withdraw from each other to adjust the tension or stretching of the fabric in the direction of its width.

4 Claims, 4 Drawing Figures

1
2
3
4
5
7a
7b
17
18
19
19'
20
20'
22
22a
23
M1
M2

PLANT FOR LIQUID TREATING TUBULAR FABRICS IN GENERAL

BACKGROUND OF THE INVENTION

This invention relates to a plant for liquid treating tubular fabrics in general. Examples of treatments for which the plant is suitable are mercerisation, washing in general, dyeing and other treatments of tubular fabrics with liquids. The invention will be described with particular reference to the mercerisation of tubular fabrics.

Mercerisation is notably a chemical treatment to which the yarn of cotton, linen and hemp fabrics is subjected, consisting of impregnating the semi-finished articles under tension with an alkaline solution, then washing the yarn or fabric to completely remove the soda. As a result of the swelling action of the alkalis, mercerisation opens the macromolecular structure of the fibres, which swell and become rounded, assuming a lustre and a capacity of uniformly absorb a dye.

In particular in the case of fabrics, to which the present invention relates, modern technology has conceived mercerisation plants comprising members of various kinds for imparting the necessary tension to the fabric, soda impregnation tanks, wash tanks and rinsing tanks through which the fabric is passed in succession. These plants extend mainly in a horizontal direction and occupy a large surface area, over which the various treatment stations are distributed in series. As stated, the main items are series-disposed tanks.

The plants existing at the present time are especially constructed for mercerisation of flat or open fabrics. When it is required to mercerise a tubular fabric, at present it is often necessary to cut the fabric, mercerise it and then re-sew it to reform the tubular structure.

It is apparent that this treatment has very negative consequences on the quality of the fabric, as a tubular fabric originally manufactured without seams comprises, after mercerisation, a longitudinal seam which interrupts the unity of the fabric, besides all the disadvantages which the seam itself presents.

Tubular fabrics are therefore in practice not mercerised in a satisfactory manner, with the result that the dyeing of the tubular fabric is not carried out or is not properly successful. This situation has given rise to the need to conceive a mercerisation plant of new and original construction, able to overcome the aforesaid disadvantage, i.e. able to mercerise tubular fabrics without in any way disrupting their unity or uniformity.

Similar considerations apply for other liquid treatments of tubular fabrics.

SUMMARY OF THE INVENTION

The object of the present invention is to provide a plant capable of perfectly liquid treating tubular fabrics of any diameter at a high production rate, without the need for operations to be carried out on the fabrics which might damage their integrity.

A further object is to provide a plant of extremely small overall floor area, therefore allowing other equipment to be installed in the region in which it is arranged.

A further object is to provide a mercerisation plant able to utilise the wash and rinse water in a particularly effective and complete manner, leading to substantial water economy.

These objects are substantially attained by a plant for liquid treating tubular fabrics comprising a first station for impregnating the fabric with a liquid, a second station for tensioning the already impregnated fabric and including washing and rinsing means for the tensioned fabric impregnated with said liquid, wherein said second station comprises at least one supporting frame structure, means defining a passage for said fabric, means for feeding the tubular fabric through said passage, at least one pair of expanding rod elements slidably arranged in opposite positions into the fabric tube being fed through said passage, support means for said expanding rod elements supported on said frame, said support means being arranged outside the fabric tube to slidably press opposite portions of said fabric tube against said expanding elements in opposite lateral expanding rod directions, and adjustment means arranged to enable said expanding rod elements to approach or withdraw from each other to adjust the tension of the fabric tube in the direction of its width.

BRIEF DESCRIPTION OF THE DRAWINGS

Further characteristics and advantages will be more evident from the description of a preferred but not exclusive embodiment of the invention, illustrated in the accompanying drawings, in which.

DESCRIPTION OF THE PREFERRED EMBODIMENTS

Figures 1, 4:
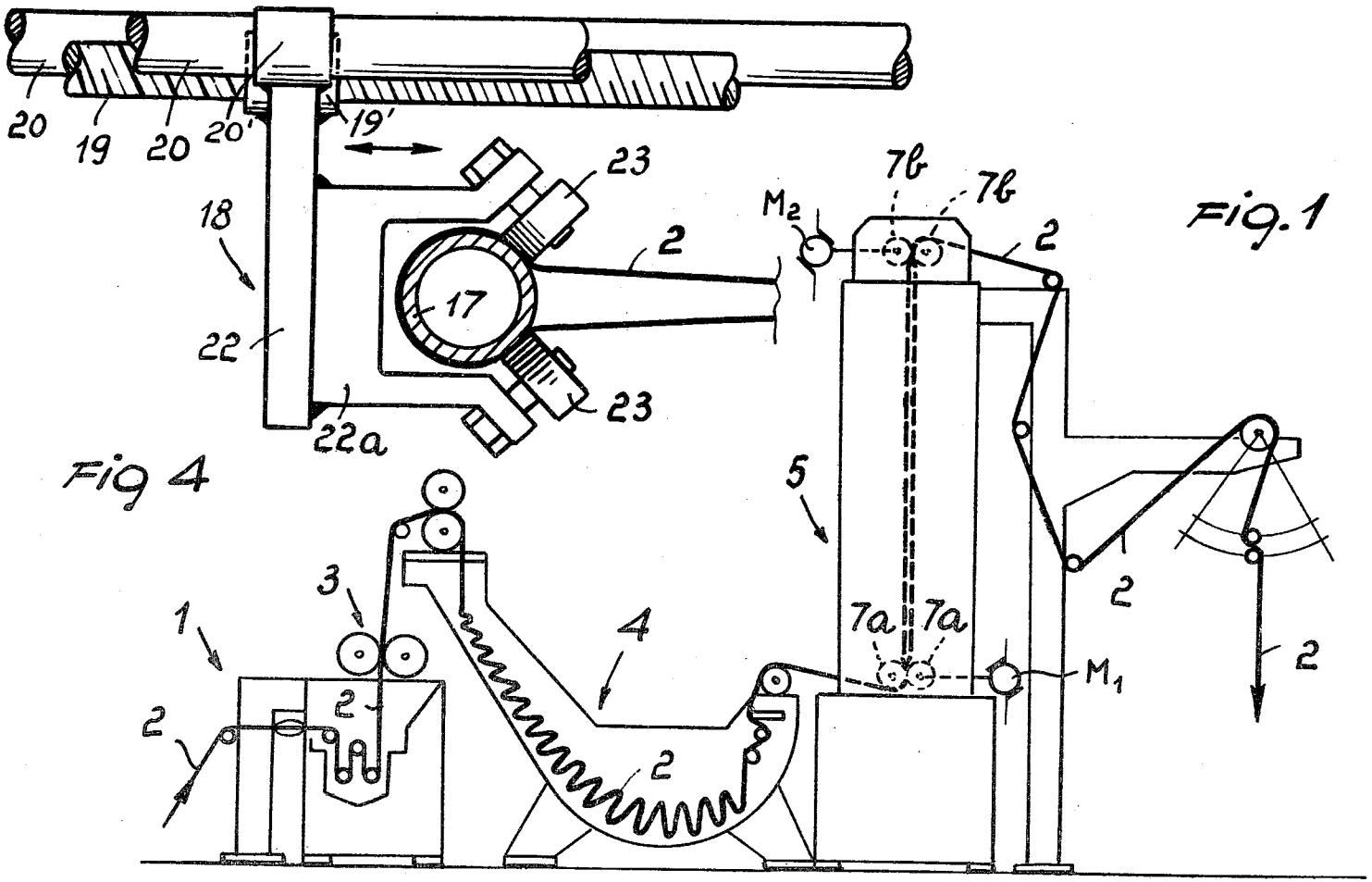
FIG. 1 is an overall diagrammatic frontal view of the plant according to the invention.
FIG. 4 is a plan view of a detail of the preceding figures.

With reference to the said figures, and in particular to FIG. 1, the mercerisation plant comprises a first station provided with an impregnation tank 1 in which the tubular fabric 2 is impregnated with caustic soda, with a squeezer 3 formed from two opposing rotating rollers, which removes the excess caustic soda present in the tubular fabric after immersion in the impregnation tank 1, with an accumulation chute 4 in which the fabric simply slides, and constructed and sized in such a manner as to allow the fabric the necessary time, in accordance with its feed velocity, for the reaction between the soda and fabric to take place, and a second station, named mercerisation station 5, in which the tubular fabric is tensioned while the caustic soda still reacts with the fabric, and then washed.

In the impregnation tank 1, in the squeezer 3 and in the accumulation chute 4, the tubular fabric 2 is treated in the same manner as a normal flat fabric. In this respect, as shown on the drawing, the drive rollers compress and flatten the tubular fabric 2 to make it substantially bidimensional.

Figure 3:
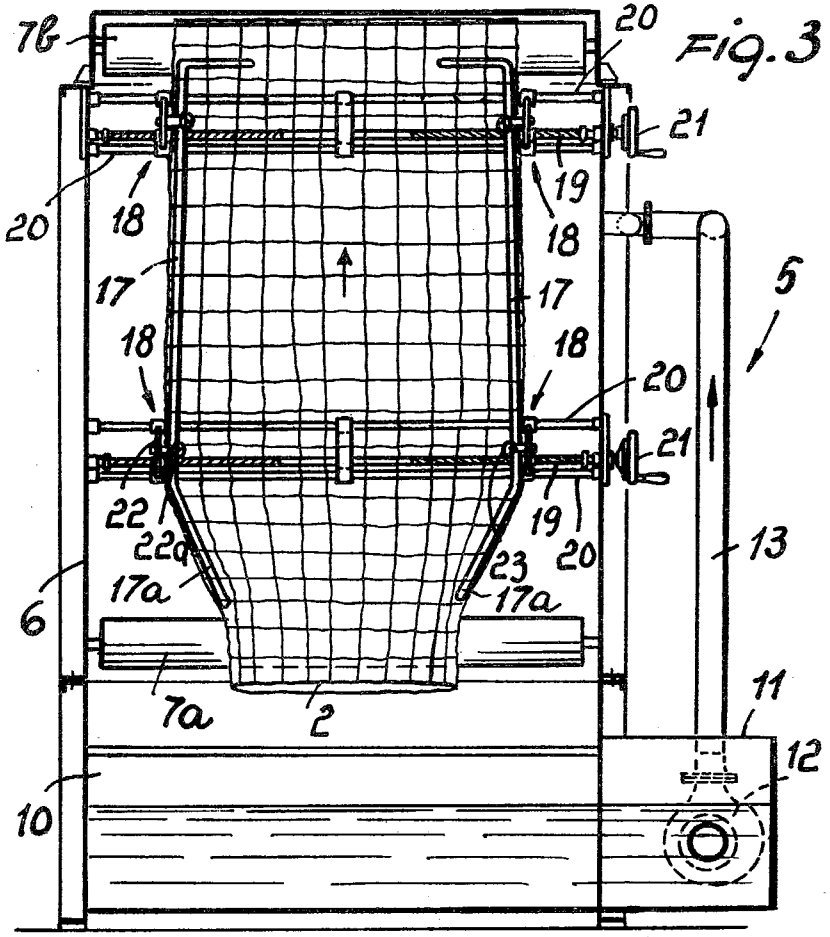
FIG. 3 is a lateral and sectional view of FIG. 2.
Figure 2:
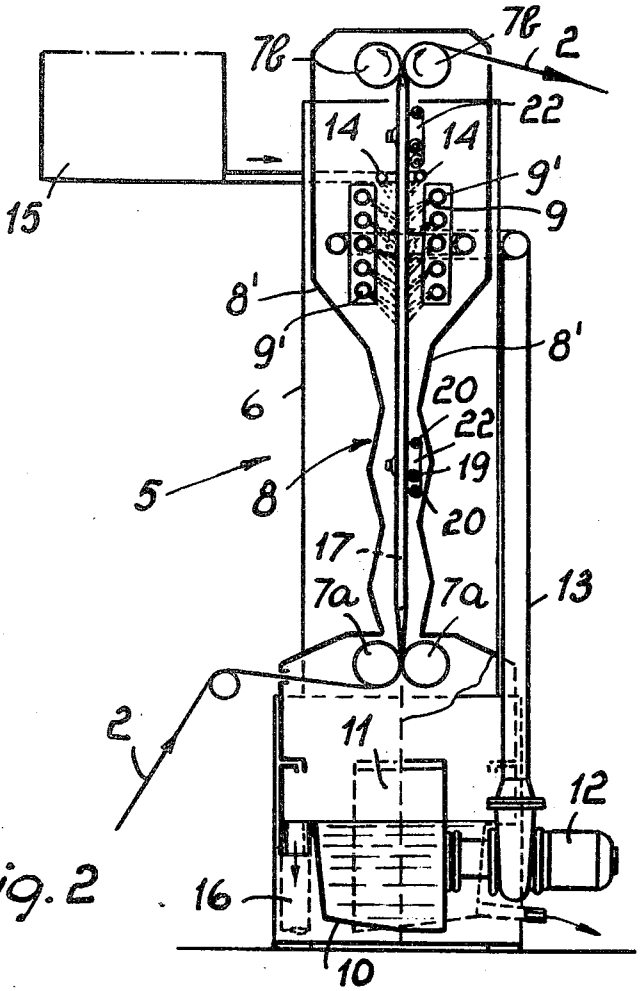
FIG. 2 is a frontal and sectional view of a station according to the invention contained in the plant of FIG. 1.

The mercerisation station 5 (in FIGS. 2 and 3, fabric 2 is shown transparent to better display the structure of the station itself) constitutes the significant element of the plant according to the invention and consists of a supporting frame structure or support structure 6 substantially shaped as a tower, i.e. of predominantly vertical extension. The supporting frame structure comprises means defining a passage for the tubular fabric 2 inside the tower 6, said passage extending vertically from the bottom upwards and means for feeding the tubular fabric through said passage. In detail said means consists of opposing rollers *7a* and *7b* at the base and top respectively. These rollers also flatten the fabric tube to make it substantially bidimensional. Between the base rollers 7a and top rollers 7b there is provided a substantially mushroom-shaped wash chamber 8 defined by walls 8'. The wash chamber 8 comprises an upper box-shaped enlargement which, besides containing the top rollers 7b, also contains nozzles 9 which spray the tubular fabric with hot water. The nozzles 9 are defined by pipes 9', which face the fabric on both sides thereof and which are provided with transverse nozzle forming holes distributed at intervals along each pipe and directing the spray jet in a countercurrent direction inclined to the fabric. The pipes 9' communicate with a collector pipe in communication with pipe 13 described below. At the bottom, the wash chamber 8 has a reduced and irregular cross-section, the walls of which are rather adjacent to the fabric tube. This reduced section is shaped in such a manner with converging and diverging surfaces, that the hot water sprayed by the nozzles 9 rebounds from the chamber walls and strikes the fabric tube several times. After washing the fabric tube countercurrently, the wash water falls by gravity into a collection tank 10 provided at the base of the tower 6. This collection tank is connected via a filter 11 to a pump 12 which recycles the wash water to the nozzles 9 through the substantially vertical pipe 13.

Spray pipes 14 are provided above the nozzles 9 to spray the rising fabric tube with clean hot water from a suitable tank 15. The clean hot water from the tank 15 is used in practice for rinsing and also flows countercurrently into the collection tank 10. The excess water in the tank 10 is discharged through an overflow pipe 16.

Simultaneously with the countercurrent washing and rinsing in the tower 6, the tubular fabric 2 is stretched or put under tension in the region between the base rollers 7a and top rollers 7b as explained below. In this respect, as shown in detail in FIG. 3, after the fabric tube has entered the base rollers 7a, it passes on to expanding or shaped elements consisting of substantially rod-like elements indicated by the reference numeral 17 as will be more fully described below. In the present embodiment, the rod elements 17 are two in number and are disposed opposite each other symmetrically about the line of feeding of the tubular fabric at a distance substantially corresponding to the half circumferential extent of the tubular fabric 2. Said rod elements have an oblique lead-in portion 17a and a straight portion 17b, these portions forming an angle therebetween which is less than a straight angle but greater than a right angle, as clearly visible in FIG. 3. The two straight portions 17b are substantially parallel or slightly reciprocally converging towards the top of the tower 6 in order to reduce the friction between the fabric and rod elements which increases as the fabric rises towards the top of the tower 6. This is because as the fabric rises it becomes increasingly free from the caustic soda and its slidability therefore reduces.

The rod elements 17 are associated with the tower support structure 6 by way of expanding means or transverse support members 18, partly shown in FIG. 4. Each of the support members 18 (in the present case there are two spaced-apart support members disposed in proximity to the ends of the straight portions 17 of the rod elements) comprises an adjustment screw 19 and two parallel guides 20 traversing the tower 6 crosswise and supported by the tower structure 6. An external handwheel 21 enables the adjustment screw 19 to be rotated manually. This latter is formed from two opposing threads terminating in its central region. At each rod element 17, the guides 20 and adjustment screw 19 carry a support 22 having sleeve like formations 20' slidably engaging the guides 20 and a nut-like formation 19' threadably engaging the adjusting screw 19 and provided with a bracket portion 22a which supports two substantially opposing wheels 23 which act on the rod elements 17 while rotatably engaging the tubular fabric 2 from outside. It will be understood that the traction exerted by the tensioned or expanded tubular fabric 2 (FIG. 4) is counterbalanced by the holding action of the wheels 23, which act on the rod-like elements 17 with the interposition of the tubular fabric 2 in opposite lateral expanding directions, but without hindering the sliding thereof. As visible in the drawings (FIGS. 2 and 3) the wheels 23 engage the fabric 2 and rod elements 17 at two longitudinally spaced apart portions of the fabric and rod elements. The wheels 23 comprise two pairs of wheels 23 arranged at an upper height and two pairs of wheels arranged at a lower height. Said adjustment screw 19, said handwheel 21 and said support 22 with the wheels 23 define adjustment means for said rod elements 17, because it is possible to displace the upper pairs of wheels independently from the lower pairs.

The rod elements 17 are held in a vertical direction by the dragging action of the tubular fabric, directed from the bottom upwards. As also deducible from the drawings they are therefore longitudinally unsupported. The rod elements 17 are arrested in their upward movement only by the reaction with the top rollers 7b. For this purpose the rod elements 17 may each have one end portion bent transversely toward the opposite rod element as visible in FIG. 3. The adjustment screws 19 and guides 20 are parallel to the rollers axes of the 7a and 7b.

According to the invention, the base rollers 7a and the top rollers 7b are driven by separate D.C. electric motors $M_1$ and $M_2$ respectively of known type, which cause them to rotate potentially at different angular speeds, namely an angular speed which is greater for the top rollers 7b than for the base rollers 7a. The fabric tube 2 is therefore also tensioned in the longitudinal direction.

For example the motor $M_2$ may be regulated in a known manner e.g. by a potentiometer so as to impart to the upper rollers a rotation with a peripheral speed of e.g. 31 m/min. and motor $M_1$ may be regulated to impart in the same way to rollers 7a a rotation with a peripheral speed of e.g. 30 m/min., the speed difference causing a sufficient longitudinal tension of the fabric.

After the mercerisation station 5, the tubular fabric 2, which has been stretched, washed, rinsed and squeezed by the top rollers 7b, progresses to a normal outlet as shown in FIG. 1.

On this basis, the operation of the plant according to the invention is as follows.

The tubular fabric 2 is firstly immersed in the impregnation tank 1, then passes between the squeezing rollers 3 where the excess caustic soda is removed. The remaining soda reacts with the fibres of the fabric as this passes through the accumulation chute 4, at the end of which the still flattened tubular fabric is inserted into the mercerisation station 5, externally defined by the tower 6. The fabric tube is inserted in proximity to the base of the tower 6 and is immediately squeezed by the base rollers 7a and then conveyed vertically to the top rollers 7b, at which the fabric leaves the tower 6. Between the base rollers 7a and top rollers 7b, the fabric tube is stretched and tensioned, washed and rinsed. The stretching is achieved both by the rod elements 17 and rollers *7a, 7b*. The rod elements 17 extend the fabric tube transversely in a direction parallel to the rollers *7a, 7b* and are positioned and inserted into the fabric tube, so as not to hinder the tube feed. At the start after an initial portion of the tubular fabric has passed between the rollers *7a*, the rod elements 17 are approached to each other and are inserted in the open end of said initial portion of the tubular fabric. The fabric is then caused to pass between the upper rollers *7b*, the rod elements 17 are shifted away from each other by acting on the screw 19 and the desired lateral tension is imparted to the fabric at horizontally opposite portions thereof. Then the apparatus is ready for continuous operation. The rod elements 17 are held in horizontal position very simply and effectively by support members 18 and wheels 23 which act from outside on the fabric tube by a sliding reaction which is adjustable according to the type of fabric and the process requirements. In practice, as shown in FIG. 4, the support members 18 cooperate with the action of the tubular fabric 2 in supporting the rod elements 17, and in fact the rod elements 17 are kept raised and are urged against the top rollers *7b* directly by the action of the tubular fabric 2.

The fabric is advantageously washed and rinsed in countercurrent with the fabric still under tension. Washing is effected by the nozzles 9 with water recycled by the pump 12, drawing from a collection tank 10 at the base of the tower 6. Rinsing is effected by the sprays 14 using fresh hot water.

The countercurrent wash action carried out in the tower 6 is made particularly effective by the fact that the wash water travels vertically in a wash chamber 8 sized and shaped in such a manner that the water in its swirling movement continuously collides with and rebounds from the taut tubular fabric. The base rollers *7a* and top rollers *7b* have the triple function of guide rollers, squeezing rollers and elements for tensioning the fabric tube in the longitudinal direction, this latter due to the fact that the rollers are driven in a manner which tends to give a different angular speed to the rollers, the greater speed applying to the top rollers *7b*, the fabric tube therefore remaining firmly taut in the direction of its extension.

The invention attains the proposed objects. In particular a mercerisation plant is provided which is perfectly suitable for treating tubular fabrics in their entirety. A simple effective device is also provided for stretching fabrics widthwise and washing them countercurrently, this being very advantageous both operationally and because of the overall size and reduced water consumption deriving therefrom. In this respect, the mercerisation station 5 according to the invention has a very small floor area and recycles the larger part of the wash water used. The original shape of the wash chamber prolongs and boosts the action of the wash liquid over a long portion beyond the region directly receiving the sprays from the jets 9.

Although providing all the said advantages, the plant is of simple structure and is easily constructed by the industry of the sector concerned.

The plant so conceived is susceptible to numerous modifications all of which fall within the scope of the inventive idea. Furthermore all details may be replaced by technically equivalent elements.

In practice, the materials and dimensions may be chosen according to requirements.

I claim:

1. A plant for liquid treating a tubular fabric comprising at least one supporting frame structure, means defining a passage for said tubular fabric within said at least one supporting frame structure, means for feeding said tubular fabric through said passage, washing and rinsing means for said tubular fabric within said at least one supporting frame structure and said passage, said at least one supporting frame structure being elongated in vertical direction and said passage extending vertically, at least one pair of elongate elements arranged within said tubular fabric fed through said passage and extending in a substantially vertical direction and spaced from one another by a distance substantially corresponding to the half circumferential extent of siad tubular fabric, expanding means arranged outside of said tubular fabric and supported by said at least one supporting frame structure for slideably pressing horizontally opposite portions of said tubular fabric against said elongate elements in opposite lateral expanding directions, said expanding means including pairs of wheels rotatably engaging said tubular fabric, wherein said elongate elements are substantially vertical rod elements longitudinally unsupported within said tubular fabric and each engaged by said expanding means through interposition of said tubular fabric at at least two longitudinally spaced apart portions thereof.

2. A plant as claimed in claim 1, wherein said pairs of wheels comprise two pairs of wheels arranged at an upper height and two pairs of wheels arranged at a lower height, said two pairs of wheels arranged at said upper height being displaceable transversely to the longitudinal extent of said tubular fabric independently of said two pairs of wheels arranged at said lower height.

3. A plant as claimed in claim 1, wherein said rod elements each comprise two portions integral with each other and forming an angle therebetween which is less than a straight angle and greater than a right angle.

4. A plant as claimed in claim 1, wherein said rod elements each comprise one end portion bent transversely toward the opposite rod element, said end portion being located proximate to the outlet of said passage.

* * * * *